United States Patent [19]

Baptista

[11] 4,317,477

[45] Mar. 2, 1982

[54] GOLF CLUB CARRIER

[75] Inventor: Roberto J. Baptista, Caracas, Venezuela

[73] Assignee: Roanto Investment N.V., Caracas, Venezuela

[21] Appl. No.: 178,762

[22] Filed: Aug. 18, 1980

[51] Int. Cl.[3] ..... A63B 55/04

[52] U.S. Cl. ..... 150/1.5 B; 294/170

[58] Field of Search ..... 150/1.5 R, 1.5 B, 1.5 C; 294/170, 159, 165

[56] References Cited

U.S. PATENT DOCUMENTS

| | | | |
|---|---|---|---|
| 368,138 | 8/1887 | Dudley | 294/170 |
| 873,192 | 12/1907 | White | 294/170 |
| 1,563,816 | 12/1925 | Worthington | 150/1.5 R |
| 2,415,314 | 2/1947 | Todd | 150/1.5 B |
| 2,486,827 | 11/1949 | Duncan | 150/1.5 B X |
| 2,738,113 | 6/1981 | Sigler | 150/1.5 B |
| 2,739,631 | 3/1956 | Hamley | 150/1.5 R |
| 2,791,255 | 5/1957 | Ogden | 294/159 X |
| 2,858,868 | 11/1958 | Wallace | 150/1.5 R |
| 2,981,562 | 4/1961 | Long | 294/170 X |
| 3,564,586 | 2/1971 | Legoff | 150/1.5 R |
| 3,799,600 | 3/1974 | Chappell | 294/165 X |
| 3,866,646 | 2/1975 | Nevard | 150/1.5 R |
| 4,154,274 | 5/1979 | Adamson | 150/1.5 R |

*Primary Examiner*—Donald F. Norton

*Attorney, Agent, or Firm*—Dennison, Meserole, Pollack & Scheiner

[57] ABSTRACT

A golf club carrier including a pair of longitudinally spaced axially aligned tubes interconnected by an elongated rigid handle. The handle, intermediate the tubes, is upwardly offset to provide a hand grip. The rear tube mounts an upwardly projecting ball container with a removable lid. This rear tube also includes a depending wide stabilizing leg incorporating sockets therein for golf tees. The handle, preferably the end portion overlapping the forward tube, includes recesses for mounting ball markers. The opposed end of the tubes can be provided with club cushioning lips.

5 Claims, 5 Drawing Figures

GOLF CLUB CARRIER

BACKGROUND OF THE INVENTION

The game of golf requires use of a plurality of golf clubs and a variety of accessories, including golf balls, tees, ball markers, and the like, all of which must be transported relatively great distances by the individual players.

Conventionally, and normally regardless of the number of clubs desired by the individual player, the clubs and accessories have been carried within rather large and cumbersome golf bags which, in themselves, contribute substantially to the weight to be borne by the player. While this substantial weight may be of little concern to the player who avails himself of a golf cart or caddy, for the player who wishes to "walk" the course carrying his own clubs, the additional weight of the conventional bag is a factor to be considered.

Various attempts have been made over the years to develop lightweight inexpensive golf club carriers which provide adequate support for the clubs, and in some instances accessories, while at the same time providing an easily handled device more readily acceptable to the golfer. For example, the following U.S. Pat. Nos. illustrate carriers basically comprising a plurality of individual tubes, each adapted to receive a single club, with an appropriate handle means securing the tubes into a common device capable of being hand-carried: 3,866,646=NEVARD, 4,154,274=ADAMSON.

The patent to Hamley, U.S. Pat. No. 2,739,631 illustrates the use of an open sided golf bag which, in effect, wraps around the club shafts.

A further solution proposed is to use spaced aligned flexible straps secured to and depending from a common support member for the reception of golf shafts therethrough. Such a proposal will be noted in the following U.S. Pat. Nos: 2,486,827=DUNCAN, 2,858,868=WALLACE.

SUMMARY OF THE INVENTION

The present invention proposes a novel carrier for both golf clubs and golf accessories which fully supports and conveniently provides for the carrying of all of the equipment essential to the playing of the game of golf.

It is also proposed that the carrier of the invention provide the equipment in a relatively protected yet freely accessible environment.

Another significant object of the invention is the provision of a carrier which utilizes minimal structural components so as to contribute little to the weight of the equipment itself. Nonetheless, the structural components are so arranged as to provide for a full support of the equipment in a completely secure device capable of being easily hand-carried.

Basically, the goals and objects of the present invention are achieved by the provision of a carrier which includes a pair of longitudinally spaced axially aligned tubes. The tubes are interconnected by an elongated rigid handle paralleling the axis of the tubes and having the gripping portion thereof, that is the portion between the tubes, outwardly offset whereby the handle can be gripped without interference with or from the supported clubs. One of the tubes, normally the rear tube, will mount an upstanding ball receiving container with a removable lid. The same tube will include a depending relatively wide support leg providing for a stabilization of the device when positioned on the ground. The leg itself will normally include multiple bores therein for the mounting of golf tees, as well as a pocket, if so desired, for a score card and pencil.

The invention also contemplates the provision of mounting sockets within one end portion of the handle for receiving ball markers. Appropriate strap receiving hooks may be provided toward the opposite ends of the handle should one wish to carry the carrier on the shoulder, somewhat in the manner of a conventional golf bag.

Finally, a protective lip may be provided about the opposed open ends of each of the tubes.

These together with other objects and advantages will become apparent from the following more detailed description of the construction and manner of use of the invention.

DESCRIPTION OF THE PREFERRED EMBODIMENT

Figure 1:
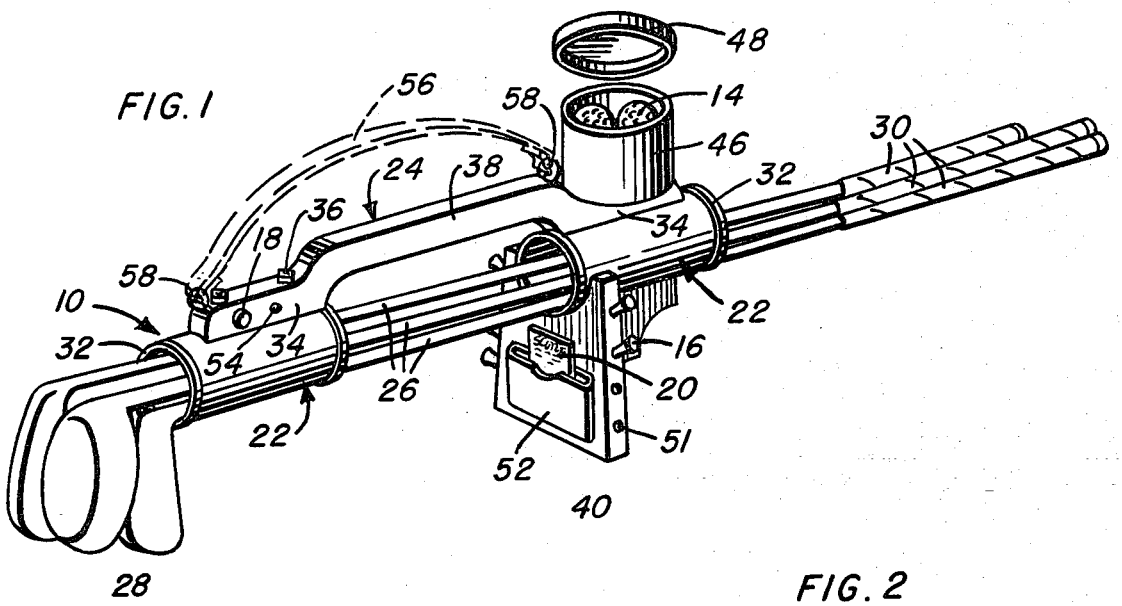
FIG. 1 is a perspective view of the carrier of the present invention with multiple clubs and accessories supported therein and thereon, and with the ball container lid in a removed position.
Figure 2:
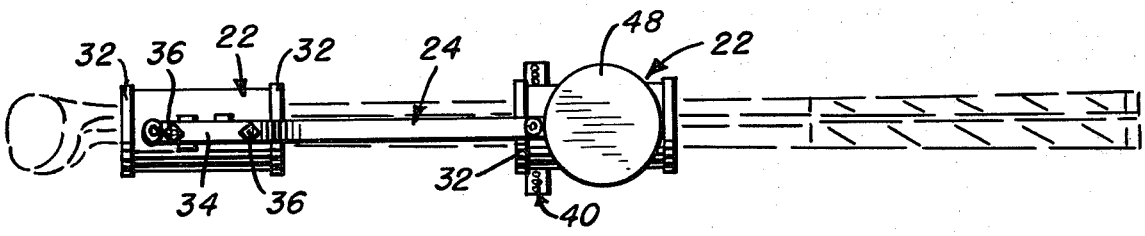
FIG. 2 is a top plan view of the carrier.

Referring now more specifically to the drawings, reference numeral 10 is used to generally designate the carrier comprising the present invention. This carrier is particularly adapted for the carrying of multiple golf clubs 12 and related accessories, including golf balls 14, golf tees 16, ball markers 18, and, if so desired, score cards 20.

Basically, the carrier 10 comprises a pair of longitudinally spaced axially aligned tubes 22 interconnected by a rigid elongated overlying handle 24.

The tubes 22, as will be appreciated from the drawings, are specifically intended for receiving the shafts 26 of the golf clubs 12 with the heads 28 of the clubs generally positioned adjacent the forward end of the forwardmost tube. The club handles 30, in turn, project a substantially greater distance rearwardly of the rear tube. The longitudinal spacing of the tubes, generally determined by the length of the handle 24, is such as to provide for a balanced loaded carrier. As will be appreciated from the drawings, the tubes, while elongated, are of a relatively short length, contributing little to the overall weight of the device, and at the same time providing both a positive two-area support for the clubs and substantially complete exposure of the club heads, shafts and handles.

The size of the tubes 22 will determine the club-carrying capacity of the carrier 10. For example, tubes of a sixty millimeter diameter will conveniently accommodate four or five clubs. Tubes of eighty-four millimeter diameter will normally be required for twelve clubs. Carriers with tubes of sixty to sixty-eight millimeters, for four to eight clubs, have been found to be particularly convenient and comfortable for carrying by the golfer.

In actual construction, the tubes, which are rigid and shape sustaining, can be of any appropriate material, preferably plastic or a lightweight metal such as aluminum. If the tubes are formed of metal, it may be desired to provide the open opposed ends of each tube with a cushioning lip or bead 32 of an appropriate medium-hard rubber or plastic capable of protecting the club shafts as they are introduced to and remove from the tubes. The lips 32 will also cushion the shafts within the tubes for both the protection thereof and a reduction of noise as the device is carried.

The elongated rigid handle 24 extends between and overlies the tubes 22. The opposed end portions 34 of the handle 24 engage the upper portions of the respective tubes 22 along a substantial length thereof and are rigidly secured to the tubes 22 by any appropriate means. For example, as illustrated, a pair of bolts 36 can be used to mount each tube 22 on the respective handle end 34. When such a mounting means is used, the bolt heads should be configured to present little or no obstructions within the intereor of the tubes 22. Other appropriate means can be utilized depending upon the nature of the materials of the tubes and handle.

Between the opposed handle ends 34, and the two tubes 22, the handle 24 is laterally upwardly offset to define an elongated central hand-grip portion 38. The offsetting of the hand-grip portion 38 allows a convenient grasping of the handle 24 without interference from the underlying club shafts 26. Further, the relatively elongated nature of the grip portion 38 allows some degree of latitude in the positioning of the hand so as to ensure a proper and comfortable balancing of the carrier 10.

Figure 3:
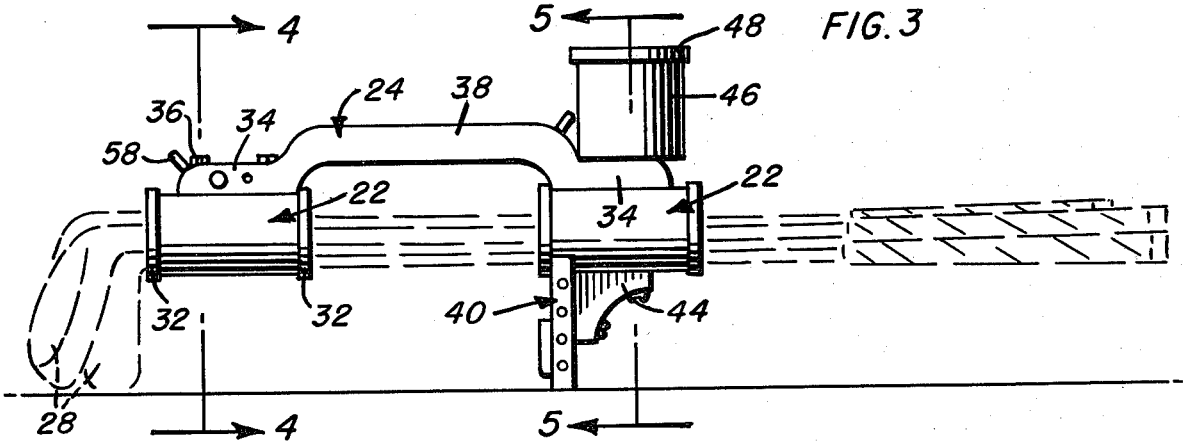
FIG. 3 is a side elevational view of the carrier.
Figure 4:
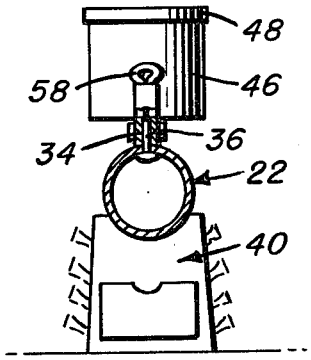
FIG. 4 is a cross-sectional detail taken on a plane passing along Line 4—4 in FIG. 3.
Figure 5:
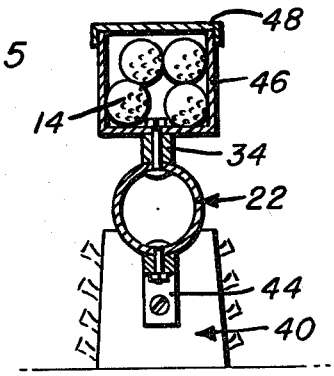
FIG. 5 is a cross-sectional detail taken substantially on a plane passing along Line 5—5 in FIG. 3.

A single depending support leg 40 is fixed to the forward end portion of the rear tube 22, the designations forward and rearward being relative to the club heads 28. This support leg 40 is positioned transversely of the corresponding tube 22 and is of a width slightly greater than the diameter of the tube whereby the tube can be comfortably positioned within an arcuate recess provided in the upper end of the support leg 40. An appropriate stabilizing brace or angle member 44 can be provided in engagement with the rear face of the leg 40 and the bottom of the rear tube 22. Again, appropriate bolt or screw means can be utilized in securing the support leg 40 and brace 44 to the tube. As will be best appreciated from FIG. 3, the height and positioning of the support leg 40 is such as to cooperate with the depending club heads 28 in providing an elevated assembly. The relatively wider base end of the support leg 40 provides substantial lateral stability to the carrier, with or without an elevation of the forward end thereof by the club heads.

The above-referred to stability is particularly desirable in that a ball container 46 is bolted or otherwise secured to the elongated rear portion 34 of the handle 24. This container, normally capable of accommodating four golf balls, is provided with an appropriate closure or lid 48 for the open top thereof. As will be noted, the container 46 is positioned rearward of the gripping portion 38 of the handle 24 to avoid interference with the hand grasping of the carrier.

In order to further adapt the carrier 10 for its intended use in a golfing environment, the opposed vertical relatively wide edges 50 of the support leg are provided with downwardly and inwardly inclined bores 51 into which golf tees can be mounted. The forward face of the leg 40 can be used to accommodate the score cards 20, either within an appropriate pocket 52 provided thereon, or by means of a rubber band (not illustrated) encircling the support leg.

It is also contemplated that the carrier 10 accommodate the ball markers 18. As such, small sockets or recesses 54 are provided along the opposite sides of the handle end portion 34 fixed to the forward tube 22.

Finally, in order to provide for the possibility of carrying the device 10 by means of a carrying strap 56, appropriate strap or strap-clip receiving eyes 58 can be provided toward the opposite ends of the handle 24.

The foregoing is considered illustrative of the principals of the invention. As modifications and changes may occur to those skilled in the art, it is not desired to limit the invention to the exact construction and operation shown and described, but rather, to encompass all suitable modifications and equivalents which are within in the scope of the invention as claimed.

I claim:

1. A golf club carrier comprising a pair of longitudinally spaced open ended tubes, said tubes being generally aligned along a common axis, a rigid handle generally paralleling said tubes and extending therebetween, said handle having opposed ends overlying and fixed to said tubes, said handle, between said tubes, being upwardly offset relative to the upper surfaces of the tubes to provide for an unencumbered hand-grip portion between said tubes, and a ball container mounted over one of said tubes, said container including an opening therein with a movable closure therefor.

2. The carrier of claim 1 wherein said tubes are rigid and of a cylindrical configuration.

3. The carrier of claim 2 including a club cushioning protective lip provided about the opposed ends of each of said tubes.

4. The carrier of claim 1 including support leg means fixed to and depending from the tube over which the ball container is mounted.

5. The carrier of claim 4 wherein said leg means includes means for mounting and retaining a plurality of golf tees.

* * * * *